US010428506B1

(12) United States Patent
Osbrach

(10) Patent No.: US 10,428,506 B1
(45) Date of Patent: Oct. 1, 2019

(54) TOILET WASH IMPROVEMENT

(71) Applicant: Allen Z. Osbrach, Merritt Island, FL (US)

(72) Inventor: Allen Z. Osbrach, Merritt Island, FL (US)

( * ) Notice: Subject to any disclaimer, the term of this patent is extended or adjusted under 35 U.S.C. 154(b) by 0 days.

(21) Appl. No.: 16/277,278

(22) Filed: Feb. 15, 2019

Related U.S. Application Data

(63) Continuation-in-part of application No. 15/965,294, filed on Apr. 27, 2018.

(51) Int. Cl.
*E03D 9/08* (2006.01)

(52) U.S. Cl.
CPC ..... *E03D 9/085* (2013.01)

(58) Field of Classification Search
CPC ..... E03D 9/085
USPC ..... 4/433, 420.1–420.5
See application file for complete search history.

(56) References Cited

U.S. PATENT DOCUMENTS 2,691,373 A * 10/1954 Bried ..... A61M 3/0233 604/248
4,287,618 A * 9/1981 Silver ..... E03D 9/085 4/420.2
4,441,219 A 4/1984 Epstein
4,903,347 A 2/1990 Garcia et al.
4,995,121 A 2/1991 Barker
5,419,363 A 5/1995 Robinson
5,937,451 A * 8/1999 Mihara ..... E03D 9/085 239/583
6,209,800 B1 * 4/2001 Thomas ..... F16L 11/04 239/195
6,973,679 B1 12/2005 Schad
7,127,750 B2 10/2006 Lim
2005/0229300 A1 10/2005 Wilcox
2008/0092283 A1 * 4/2008 Cruz ..... E03D 9/085 4/420.4
2008/0116226 A1 5/2008 Py et al.
2008/0216226 A1 * 9/2008 Hamlin ..... A47K 3/001 4/443

(Continued)

OTHER PUBLICATIONS

Cleanstream Toilet Enema Attachment Set: Health & Personal Care, retrieved from http://www.amazon.com/Cleanstream-Toilet-Enema-Attachment-Set/dp/B01HQWYJQ0, retrieved on Apr. 26, 2018, 6 pages.

(Continued)

*Primary Examiner* — Huyen D Le
(74) *Attorney, Agent, or Firm* — Brian S. Steinberger; Hilary F. Steinberger; Law Offices of Brian S. Steinberger, P.A.

(57) ABSTRACT

Systems, devices, and methods for providing are refreshing wand with disposable rubby rinse head that can be washed and/or disposed that can be attached to a toilet water supply that can be used with toilet paper to remove vaginal discharge fecal matter material and urine that wiping was not able to remove. Toilet wash 1 as a dual shut off valve and toilet wash 2 use the existing shut off valve with the splitter. The valves can be used for supplying water to the refreshing wand with disposable rubby rinse head. The disposable rubby rinse head can be washed and/or disposed. The new disposable rubby rinse head replaces the need to replace the plastic tube because the silicone cover is the only piece that comes in contact with human waste.

16 Claims, 12 Drawing Sheets

(56) References Cited

U.S. PATENT DOCUMENTS

2011/0302709 A1* 12/2011 Taylor ..... A47K 7/08
4/443

OTHER PUBLICATIONS

Cleanstream Silicone Comfort Nozzle Enema Attachment, retrieved from http://www.amazon.com/Cleanstream-Silicone-Comfort-Nozzle-Attachment/dp/B00767N, retrieved on Apr. 26, 2018, 6 pages.
Toilet Enema Attachment Set, Enema Supply, retrieved from https://enemasupply.com/products/toilet-enema-attachment?variant=35314199250&gclid=, retrieved on Apr. 26, 2018, 2 pages.
GoBidet Hand Held Bidet in White, retrieved from https://www.homedepot.com/p/GoBidet-Hand-Held-Bidet-In-White-2012W/204622705, retrieved on Apr. 26, 2018, 2 pages.

* cited by examiner

TOILET WASH IMPROVEMENT

RELATED APPLICATION

This application is a Continuation-In-Part of U.S. patent application Ser. No. 15/965,294 filed Apr. 27, 2018, which is incorporated by reference in its' entirety.

FIELD OF INVENTION

This invention relates to improving personal hygiene to maintain health and prevent the spread of diseases such as but not limited to viruses, parasites and bacteria, and in particular to systems, devices, and methods for providing here after is referred to as refreshing wand which is reusable when used with disposable rubby rinse head or wand heads here after is referred to as disposable rubby rinse head that can be easily and quickly attached to a toilet water supply that can be used with toilet paper to remove vaginal discharge, fecal matter material, urine that wiping alone cannot completely or efficiently remove. The use of the invention is a huge improvement over toilet paper and existing bidets. Because the invention efficiently removes waste material, that contributes to infections from parasites. The invention not only cleans the waste on the surface, it also penetrates and cleans under folds, rough skin, divots, anal fistula, tunnel and canals-like passage-way, and external hemorrhoids that toilet paper and or existing bidets does not clean satisfactorily. The toilet wash can do deep cleaning that existing bidets cannot get to. The toilet wash with the disposable rubby rinse head rubs the surface as it sprays water, the rubbing opens up folds, rough skin, divots, anal fistula, tunnel and canals-like passage-way, and external hemorrhoids that spraying the surface with traditional bidets cannot penetrate the skin's hiding places. This is a perfect environment for the parasites that inhabit humans' private areas. Making our privates cleaner and more parasite free, from parasites that live on and in between the anus and the vagina.

BACKGROUND AND PRIOR ART

The popular use of toilet paper after a bowel movement does not remove the entire human's waste from a person's body. In fact, the action of wiping with toilet paper actually spreads waste over the area that was wiped leaving an unpleasant odor and leaving a perfect environment for parasites that live in human waste that can cause other health issues. The waste harbors parasites that can travel from the anus into a woman's vaginal opening and into the urethra, that can cause infections such as but not limited to the *C. difficile* which are highly contagious. This should not be glossed over because common sense dictates leaving surface waste material on your body can only be hazardous. Just using more toilet paper does not fix the problem since excessive amounts of toilet paper can cause uncomfortable skin abrasions. Excessive use of toilet paper is also a waste of paper which can become expensive over time. In addition, excessive amounts of toilet paper can cause a toilet to become clogged and need to be separately cleaned.

Inflammatory bowel diseases (IBDs) such as but not limited to *Clostridium difficile* or *C. difficile* can occur from bacteria in the anal areas. *Clostridium difficile* or *C. difficile* is a bacterium. People can get infected if they touch surfaces contaminated with feces, and then touch their mouth. Health care workers can spread the bacteria to their patients if their hands are contaminated. The symptoms of *C. difficile* can range from diarrhea to life threatening infections of the colon. It can exist in a low oxygen environment. It is considered one of the most common causes of infections in the colon.

The toilet wash with the disposable rubby rinse head will reduce or annihilate the *C. difficile* when it is used. By uncovering in washing under the folds and crevices that toilet paper and bidets cannot reach, to eliminate the waste that harbors diseases such as but not limited to *C. difficile*.

Bidets are not that effective because like toilet paper its function is to clean waste on the surface. The spraying from bidets will clean better than toilet paper but will not clean waste material that is covered by folds, rough skin, divots, anal fistula, tunnel and canals-like passage-way.

A refreshing wand with the disposable rubby rinse head will remove waste that harbors the parasites that can cause diseases and infections that exists with using toilet paper and bidets. Therefore, we need a more effective solution. The head of an existing a bidet is not disposable or cleanable. Bidets are held under a person's private with the water hits the private's and splashes down onto the surface of the bidet. This creates a potential for disease to be transferred to the next person that uses the bidet. An embodiment of the subject invention comes with disposable rubby rinse heads which is open on both ends. The water cannot be trapped inside. It is also disposable by simply sliding it off the refreshing wand. Eliminating the possibilities of transferring infections Bidets are quite a contrast to the toilet wash invention where the disposable rubby rinse head is the only part that comes in contact with human waste in is disposable. It is an approximately 2" long. And it simply slides off and on, with no fasteners needed making it disposable or washable. It is washable unlike the bidets that are being sold. It should have a different name than current bidets.

The only part of this embodiment that is exposed to water that comes offer a person's private is the disposable rubby rinse head. For approximately $0.25 somebody could replace it or simply slide it off and wash it off as they are washing off their hands with an anti-bacteria soap.

The invention refreshing wand in the disposable rubby rinse head can be removed and can be washed with anti-bacterial soap or can be discarded.

The toilet wash invention offers deep cleaning by uncovers waste material that the bidets cannot get to creating a potential to reduce bacterial infections that lie on the under folds of skin and occasionally travel into the vaginal canal.

Portable bidets are limited and do not offer exchangeable heads, disposable parts, or the cleaning potential of the invention disposable rubby rinse head because none of the existing products are used to uproot waste that lies under folds of skin. The invention far exceeds the bidets ability to flush out waste material that is protected by rough skin, folds, divots, anal fistula, tunnel and canals-like passageway, and hemorrhoids The existing bidets use a stream of water that does not efficiently penetrate under the folds.

Thus, the need exists for solutions to the above problems with the prior art.

SUMMARY OF THE INVENTION

A primary objective of the present invention is to provide systems, devices, and methods for providing a refreshing wand with a disposable rubby rinse head. The disposable rubby rinse heads can be easily attached and detached to a toilet water supply that can be used in combination with toilet paper to remove vaginal discharge, fecal matter material and urine that wiping was not able to remove efficiently or completely.

A secondary objective of the present invention is to provide systems, devices, and methods for providing a refreshing wand with a disposable rubby rinse head that can be washable and/or disposable, for used with toilet paper to remove vaginal discharge, fecal matter material and urine that wiping was not able to efficiently or completely remove, which is less expensive than using extra amounts of toilet paper as a cleaning wipe.

A third objective of the present invention is to provide systems, devices, and methods for providing a refreshing wand with a disposable rubby rinse head that can be washable and/or disposable, for use with toilet paper to remove vaginal discharge fecal matter material and urine that wiping was not able to efficiently or completely remove, which reduces the chances of clogging the toilet.

Because it takes greater amounts of toilet paper as a single cleaning source.

A fourth objective of the present invention is to provide systems, devices, and methods for providing a refreshing wand with a disposable rubby rinse head that can be washable and/or disposable, for use with toilet paper to remove vaginal discharge, fecal matter material and urine that wiping was not able to efficiently or completely remove, which is less harmful to the skin than using extra toilet paper as the sole cleaning source.

A fifth objective of the present invention is to provide systems, devices, and methods for providing a refreshing wand with a disposable rubby rinse head that can be washable and/or disposable that create a deeper and more thorough cleaning, for use with toilet paper to remove feces that is on and under and in between under folds, rough skin, divots, anal fistula, tunnels and canal-like passageways. These materials are but not limited to vaginal discharge, fecal matter material and urine. That toilet paper or current bidet alone cannot remove the waste that is beneath the surface.

A sixth objective of the present invention is to provide systems, devices, and methods for providing a refreshing wand with a disposable rubby rinse head that can be washable and/or disposable that create a deeper and more thorough cleaning, for use with toilet paper to remove parasites that are in waste material under folds, rough skin, divots, anal fistula, tunnel and canals-like passage way, and external hemorrhoids of remove.

For proper hygiene, it is well known that we do not accept just wiping our hands before eating; we thoroughly wash our hands to prevent contamination, then we dry our hands with paper towels.

The subject invention takes the hand washing and wiping concept and applies it what a user should be similar to what we should be doing after using the bathroom.

An embodiment of the toilet wash system, can include existing toilet shut off valve which is an attached to an splitter having an inlet for being attached to a toilet water supply, and having a first outlet and a second outlet, a first supply line attached to the first outlet and an opposite end for being attached to a water inlet port of a toilet, a second supply line attached to the second outlet and an outlet end, a single valve with an inlet port attached to the outlet end of the second supply line, and an outlet, and an elongated cleaning tube having an inlet end attached to the outlet of the single valve, and an outlet end, wherein the outlet end of the cleaning tube is used to flush waste away.

The toilet wash system can further include a disposable removable tip for being attached to the outlet end of the cleaning tube.

The removable tip can include a generally uniform cylindrical shape formed from a pliable soft material.

The removable tip can include a base opening that has a larger diameter than an outer tip end, wherein the narrower diameter tip end forms a jet stream for cleaning. The removable tip can include an external end having longitudinal parallel slits that form fingers for use a cleaning brush.

The slits can have a length of approximately ½ inch. The slits can have a length of approximately ⅜ inch. The slits can have a length of approximately ½ inch.

The disposable elongated cleaning tube can include a disposable paper straw.

The elongated cleaning tube can include a reusable plastic when used with the disposable rubby rinse head. The plastic elongated cleaning tube can include a plurality of parallel rings which are the create the bendable section, the bendable section starts after smooth unbendable section ends. The smooth unbendable starts at the very beginning and the very end of the tube, and is approximately 1" inch long. The bendable section starts after the unbendable sections end. So, in other words the bendable section is located in the center of the tube. And the fixed sections or the beginning of the tube and the end of the tube.

Bendable section starts after the smooth unbendable section ends. The plurality of parallel rings can be used for allowing the outlet end of the tube to be selectively bent from a straight position to an approximately 90 degree bend.

The disposable elongated cleaning tube can include a disposable silicone tube.

The plastic tube can be reusable, when it is used with the disposable rubby rinse head. The elongated cleaning tube can include a plurality of parallel rings between the inlet end and the outlet end of the tube, the plurality of parallel rings allowing the outlet center of the tube to be selectively bent from a straight position to an approximately 90 degree bend.

The elongated cleaning tube can include a selectively bent angle between a mid-portion of the tube, and within 1" inch from the end of the tube.

The selectively bent angle can be between approximately 20 degrees and approximately 90 degrees. The selectively bent angle can be approximately 45 degrees.

The toilet wash system can further include a barb connector having one end attached to the main valve and an opposite end having a plurality of barbs that are press fit into the inlet end of the paper, plastic and silicone tubes.

The disposable tube can include a paper tube having an inlet end that fits over the approximately 3/16" hose barb.

The reusable plastic, when it is used with the disposable rubby rinse head tube can include a package of a plurality of identical elongated cleaning tubes.

A toilet wash kit can include a splitter having an inlet for being attached to the toilets existing shut off valve which supplies the water. To the splitter which has a first outlet and a second outlet, a first supply line attached to the first outlet and an opposite end for being attached to a toilet, a second supply line attached to the second outlet and having an outlet end, and an elongated cleaning tube having an inlet end attached to the second outlet of the splitter, and an outlet end, wherein the outlet end of the cleaning tube is used to flush waste away.

The toilet wash kit can further include removable cleaning tips for being attached to the outlet end of the cleaning tube.

Further objects and advantages of this invention will be apparent from the following detailed description of the presently preferred embodiments which are illustrated schematically in the accompanying drawings.

BRIEF DESCRIPTION OF THE FIGURES

The drawing figures depict one or more implementations in accord with the present concepts, by way of example only, not by way of limitations. In the figures, like reference numerals refer to the same or similar elements.

DESCRIPTION OF THE PREFERRED EMBODIMENTS

Figure 1:
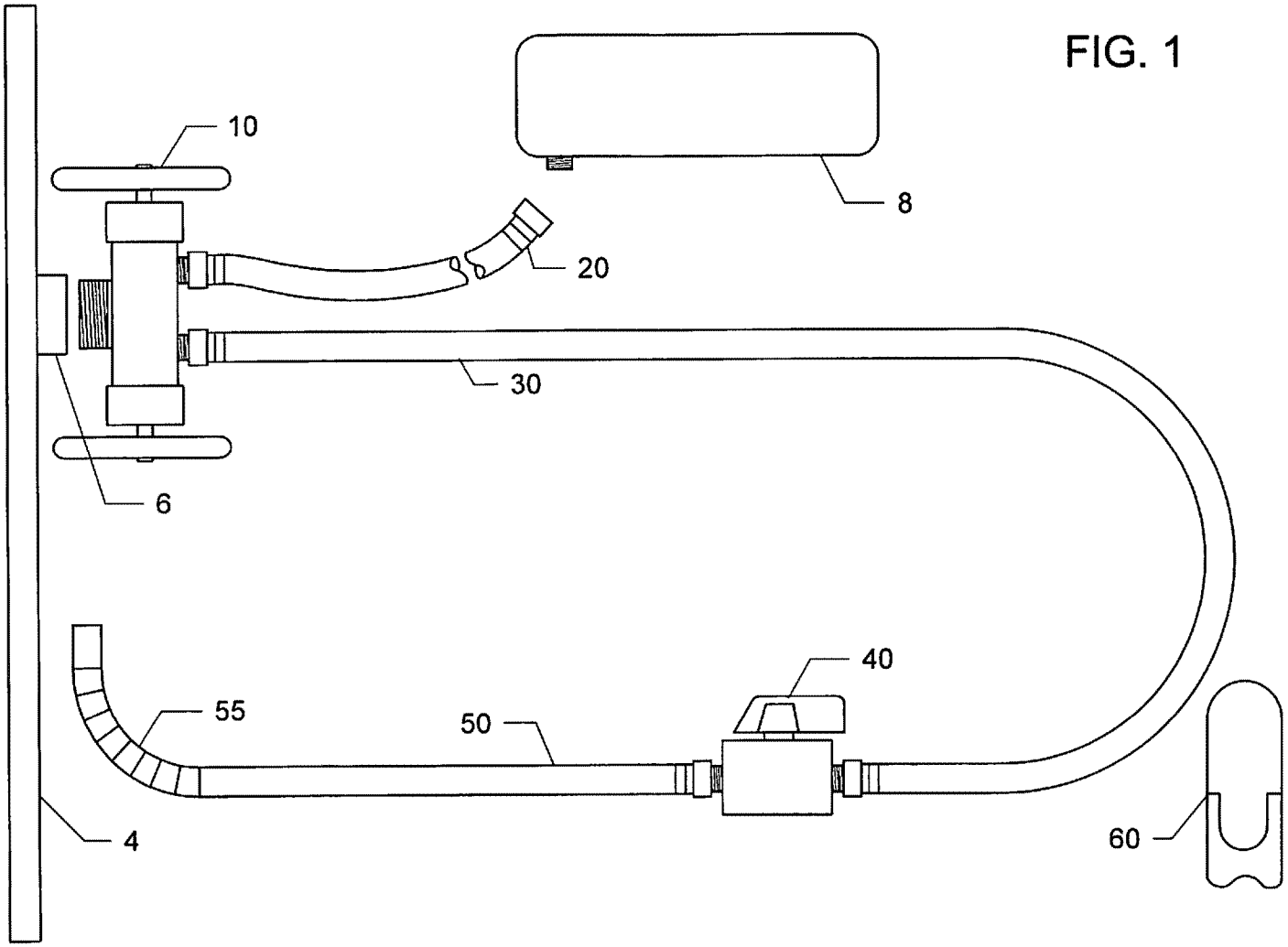
FIG. 1 is an exploded view of the toilet wash cleaning system.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification does not include all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein.

Rather, these embodiments are provided so that this disclosure will be thorough and complete, and will convey the scope of the invention to those skilled in the art. Like numbers refer to like elements throughout, and prime notation is used to indicate similar elements in alternative embodiments.

A list of components will now be described.

1 Toilet wash system
4 wall
6 water supply line inlet/connections/fittings in wall
8 toilet (water closet)
12 existing toilet shut off valve
10 toilet wash dual outlet shut off valve with 2 valves
20 supply line/hose to water closet
30 supply line for wash system
40 main toilets wash single valve for control of the flow rate of the cleaning.
42 toilet wash 1—Disposable paper tube, cellulose (paper) tube which is bio degradable. It can be flushed down the toilet after being used.
44 toilet wash reusable bendable plastic tube or refreshing wand, when used with the disposable rubby rinse head. The toilet wash tube, when used with the disposable rubby rinse head is reusable. The wands/tubes/straws or refreshing wand is now reusable because of the NEW addition of the different silicone tips create a less expensive and a more sanitary environment.
54 the disposable silicone tube can be reusable if people use it like a toothbrush where everybody has their own toothbrush. The disposable silicone tube comes in different colors in an effort to communicate that nobody should be using anybody else's silicone tube.
55 toilet wash plastic refreshing wand with fixed bent section or refreshing wand with bendable parallel rings
60 another embodiment wash system
70 barb connector
75 barbs
80 refreshing wand change from the Spray wands/tubes/straws.
90 refreshing wand change from the spray wand slight bendable section.
100 refreshing wand change from the spray wand maximum bendable section.
110 refreshing wand change from the Spray wand flat section inner end for compression fitting to barb connector.
115 toilet wash spray wand flat or refreshing wand flat section are the outer end for compression fitting for the disposable rubby rinse head that can be washable and/or disposable. This new application or toilet wash is for the purpose of creating an approximate 2" inch silicone tube (heads) that is at the end of the refreshing wand. For the purpose of making the toilet wash more effective cleaner. The toilet wash has silicone brush cylindrical that are used to rub areas that it is spraying for additional deep cleaning that spraying alone will not do. This creates a deeper cleaning then the toilet wash 1 is.

130 disposable rubby rinse head or Wand/brush head that can be washable and/or disposable approximately 2" long (Jet Steam) sprays and rubby at the same time, for stubborn waste material.

140 disposable rubby rinse head or that can be washable and/or disposable (Comb Brush) approximately 2" long with approximately ½" bristles. Deep Bristles to rub and spray at the same time for stubborn waste material

150 Comb brush approximately 2" long with approximately ⅜" bristles. Medium bristles to rub and spray at the same time for stubborn waste material

160 Comb Brush-toilet wash 2 comb brush head that can be washable and/or disposable that is approximately 2" long with approximately ¼" bristles. Bristles to rub and spray for stubborn waste material

170 Smooth Touch toilet wash 2 Smooth Touch head has a smooth slick surface to slide gently over skin, for sensitive skin. It is for washing sensitive skin. It is washable and/or disposable that is approximately 2" long a gentle rubbing and spray surface dirt away.

180S, 180M, 180D Comb cleaning fingers/rubbing bristles/slits.

190 Straw connection end on tip is the jet stream fitting

200 Water outlet on tip is the nozzle of the jet stream

210 Splitter fitting.

220 Splitter-wall fitting connection/end, with approximately ⅜" female to buildings existing water supply line

230 Splitter—toilet connection with approximately ⅜" male to water closet

240 Splitter connections with approximately ¼" male to toilet wash

Figure 2:
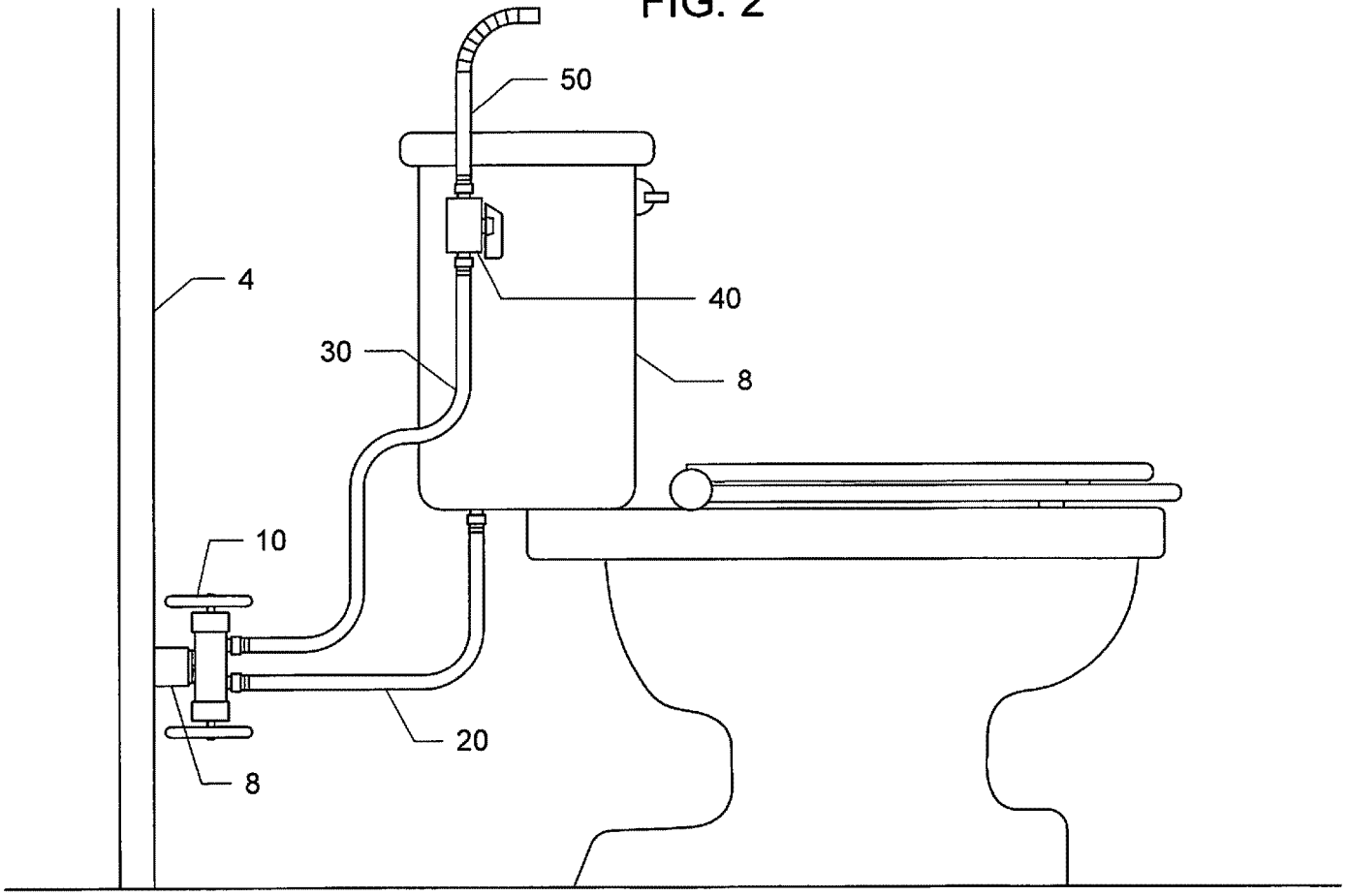
FIG. 2 is another view of the toilet wash system of FIG. 1 assembled together and attached to a toilet ready for use.

FIG. 1 is an exploded view of the toilet wash cleaning system 1. FIG. 2 is another view of the toilet wash system 1 of FIG. 1 assembled together and attached to a toilet 8 ready for use.

Referring to FIGS. 1-2, the toilet wash system can include dual outlet shut off valve 10 (dual outlet shut off valve has been replaced with the splitter in toilet wash 2 (See FIGS. 4A-4D) having an inlet port that can be attached to the water supply line outlet 6 that is usually located on a wall 4 of a bathroom.

The dual outlet shut off valve 10 can have two rotatable knobs that each control water outflow from the dual valve 10. A first outlet from the valve 10 can pass through an approximately ⅜" supply line to a water closet (toilet) 8.

The second outlet from the dual valve 10 can control water supply to an elongated supply line 30, that can have two approximately ¼" fittings on both ends. The outer end of the supply line 30 can be attached to a main valve 40 having a rotatable lever, such as but not limited to an approximately ¼" mini brass valve (female×female NPT).

Main valve 40 can have an outlet port that allows for a base of a reusable refreshing wand 50 to be attached there to. The reusable refreshing wand 50 can have at least one bend 55 for allowing the outer end to be used as wand to direct water flow to a desired area. The refreshing wand 50 can have a cylindrical outlet tip. Optionally, the outlet tip can be oval opening to better direct a water spray.

Referring to FIGS. 1-2, when a person is ready to wipe themselves after using the toilet 8, they can wipe themselves in the traditional way and then use the toilet wash system 1 by spraying water from there refreshing wand 50 on to the external areas that came in contact with surface waste material. To remove additional residue that toilet paper could not. Or simply skip wiping themselves and rinse them self off with the toilet wash system 1.

The toilet wash system 1 will remove but not limited to fecal material, urine and menstrual discharge materials (here after referred to as surface waste material) that stayed on the surface of your body that wiping was not able to completely remove. After washing with the toilet wash system, toilet paper can be used to dry those areas.

The toilet wash system rinses off a person's private areas with a refreshing wand 50 so the possibility of spreading bacteria, viruses or fungi to the next person that uses the toilet 8 is greatly reduced.

The toilet wash system 1 can improve our health habits by removing the surface waste materials left on the person after using the bathroom. The toilet wash system 1 does that by washing off any surface waste materials by using a stream of water through the refreshing wand 50 to wash off any residue of waste remaining on the person's body. This reduces the possibility of that person spreading disease when coming in contact with another person. Because the refreshing wand 50 is reusable because only the disposable rubby rinse head are in contact with human waste. The possibility of contamination from the surface waste material is eliminated. The disposable rubby rinse head 80 is then disposed of after a single use, similar to the disposal of toilet paper.

The disposable paper tube 52 is disposable and can only last for one cleaning. For those that want cellulose (paper) biodegradable that can simply be flushed down the toilet. A preferred embodiment of the disposable paper tube includes a length of approximately 7 & ¾", an outside diameter of approximately 15⁄64", and an inside diameter of approximately 3⁄16".

The cellulose (paper) tubes can resemble straws and include a plurality of rings 55 along their length and preferably the rings located between a mid-portion of the tube and the outlet end of the tube. The plurality of rings 55 (FIG. 3) allow for the tube to be easily bendable from a straight position to bend up to approximately 90 degrees or more.

Figure 3:
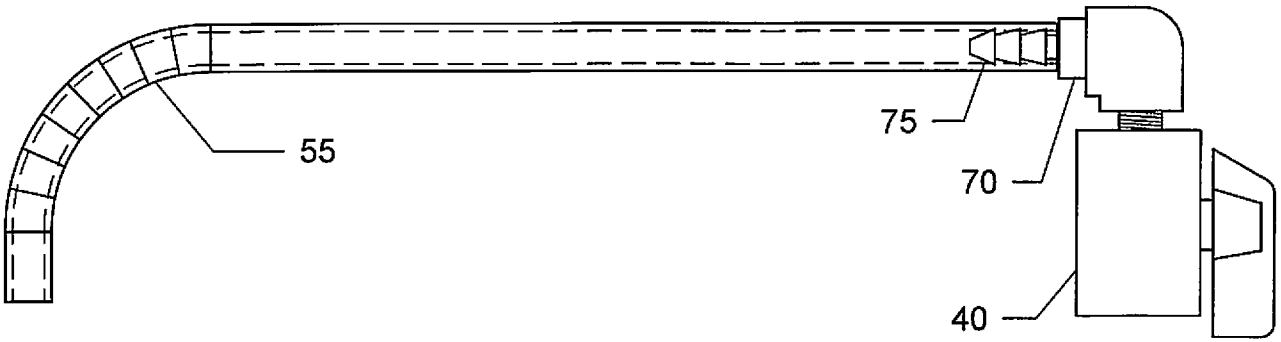
FIG. 3 is an enlarged cross-sectional view of the hose barb adapters which provide a friction fit to attach the spray wand to the main valve.

The disposable paper (cellulose) straw 52 can be sized to fit an approximately 3⁄16" hose barb as shown in FIG. 3.

The plastic tubes in toilet wash 1 are disposable and still are disposable if not used with the silicone rubber tip called the disposable rubby rinse head. In this new TOILET WASH IMPROVEMENTS several types of silicone tips were added, making it a more effective and adding more ways to sanitize the cleanup of after urinating, vaginal discharge or a menstrual period. The disposable rubby rinse head far exceeds existing bidets with fixed head because they are not removable or easily cleaned. Therefore, this invention is a big step in improving the health of people. Toilet wash 1 is improvements with the new silicone rubber tips. They are called disposable rubby rinse head 50. It should always be used with the refreshing wand. The refreshing wand is a unique design that should be replaced if it is not used with the disposable rubby rinse head, after a single use without the disposable rubby rinse head it should be thrown a way, that will ensure that disease will not be spread to the next person.

A first preferred embodiment of the plastic straw can include a length of approximately 10 & ¼", an outside diameter of approximately 7⁄32", and an inside diameter of approximately 5⁄16".

The plastic straw refreshing wand 50 can be sized to fit an approximately 5⁄16" hose barb (as shown in FIG. 3).

A second preferred embodiment of the plastic straw can include a length of approximately 10 & ½", an outside diameter of approximately 11/32", and an inside diameter of approximately 5/16".

A third preferred embodiment of the plastic straw can include a length of approximately 11 & ⅞", an outside diameter of approximately 11/32", and an inside diameter of approximately 5/16".

A fourth preferred embodiment of the disposable silicone tube can be made of silicone. The silicone tube can include a length of approximately 10 & ⅜", an outside diameter of approximately 0.45", and an inside diameter of approximately 0.35". They come in various colors so if an individual decides to reuse a silicone tube, they can simply keep using the same one. In the same way a toothbrush is used.

The toilet wash system 1 can start with a dual outlet shut-Off valve 10 which would replace the existing single toilet valve. Once the existing toilet valve is removed and replaced with the dual outlet shut-off valve 10, the approximately ⅜" supply of the dual outlet shut-off valve 10 will be reattached to the toilet 8. Water from the approximately ¼" side of the dual outlet shut-off valve 10 can be used to supply water for the toilet wash system 1.

A water supply line 20 can be attached on one end to the dual outlet shut-off valve 20 and the other end can be attached to an adapter compression inch OD×inch MIP(C) for the purpose of connecting it to the approximately ¼-inch mini brass ball valve 40. The mini brass ball valve 40 can achieve the desired amount of water flow of water.

Referring to FIGS. 1-3, on the other side of the mini brass ball valve 40 can include a hose barb adapter connector 70 having barbs 75 that can come in three sizes approximately 3/16" or approximately 5/16" or approximately ⅜"×approximately ¼" MIP.

The Hose Barb Adapter connectors 70 can allow the user to use different size refreshing wand 50, 52 and 54. The user can simply slide the refreshing wand 50, 52 and 54 on the hose barb adapter connector 70 and turn on the water by rotating lever on main valve 40. The refreshing wand 50 simply slides on and off with no clamps or fasteners it simply uses friction.

The inherent design of a hose barb adapter connector 70 is to slide the refreshing wand 50,52 and 54 over the hose barb adapter connector 70 where its leak free. This creates a quick and effortlessly way to clean yourself with the flow of water that will remove materials that toilet paper can't remove.

Three different hose barb adapter connectors 70 can be used, which include a straight (not shown) hose barb adapter connector, an approximately 45° hose barb adapter connector and an approximately 90° hose barb adapter connector. The approximately 90 degree hose barb adapter connector would work best.

The disposable toilet tube can come in different materials paper (cellulose) and plastic. The paper refreshing wand 52 is the most environmentally friendly and can be flushed down the toilet which makes it similar to toilet paper in that respect. It can be preferred because it is more, narrow making it easier to get closer to the surface waste materials.

The plastic refreshing wand 50 can be the least inexpensive. All refreshing wand 50 should be thrown away after every use if it is not used with the disposable rubby rinse head, and it cannot ever be used internally. The water passing through the refreshing wand 50 can clean the external body parts such as but not limited to: penis, anus and vagina here after referred to as private areas.

The refreshing wand 50 can be held by the person sitting on the toilet 8. The person can use the water coming out of the water to wash off the private areas. After using the refreshing wand 50 it should always be used with the disposable ruby rinse head to ensure that there is no possibility of transferring of germs to the next person. A new disposable ruby rinse head 52 should be installed to ensure that there is no possibility to spread any type of germs or parasites.

After a new disposable rubby rinse head 52 is installed, the single mini ball valve 40 can then be placed in the valve holder 60, that can be mounted to a side of the toilet 8, or the side of a wall, and the like.

The toilet wash system 1 is a unique way to keep bacteria, viruses, parasites, and fungus off of private areas of humans.

Figure 4A:
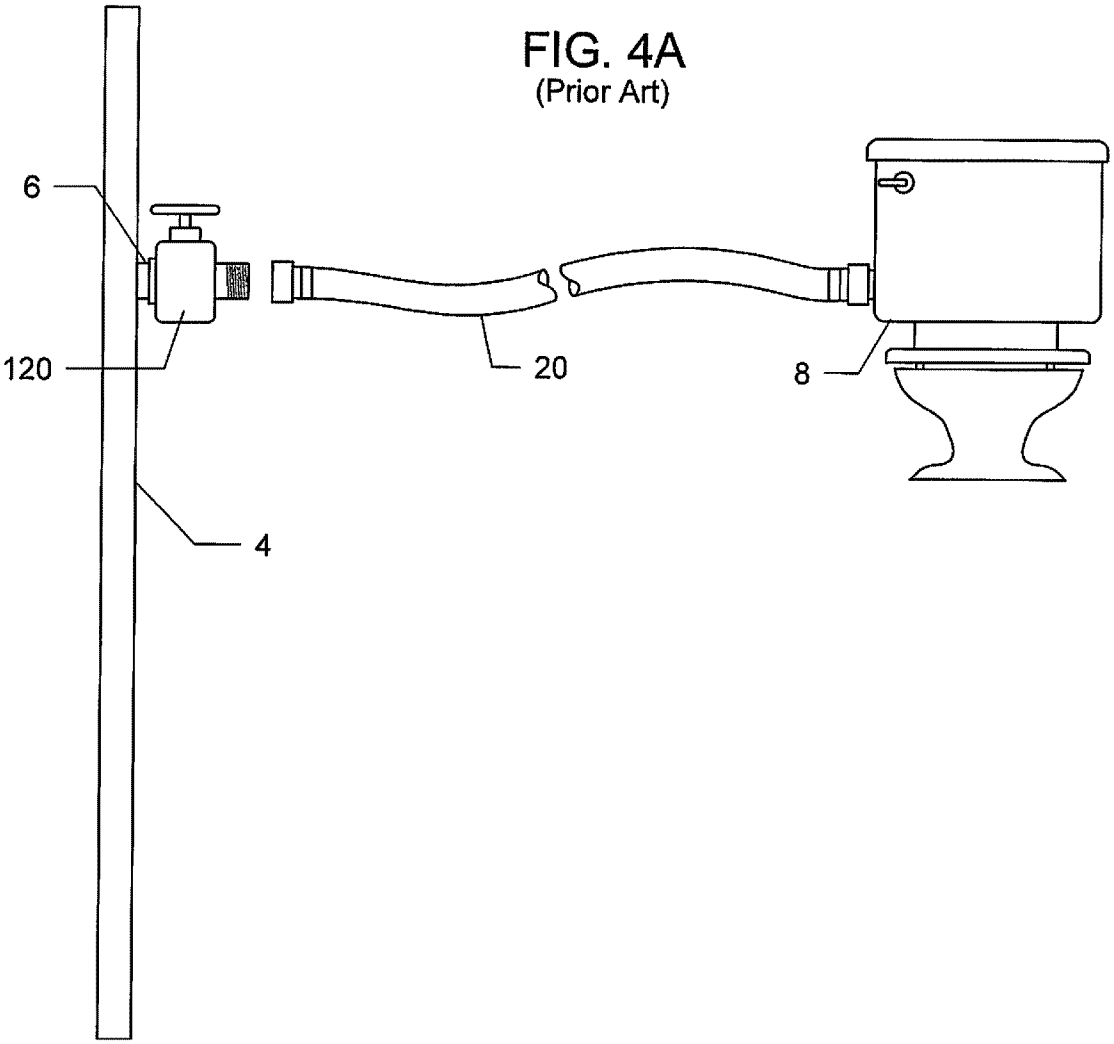
FIG. 4A (Prior Art)
FIG. 4A shows a prior art conventional toilet water supply connection with the supply hose disconnected from the wall fitting.

FIG. 4A shows a prior art conventional toilet water supply inlet/connection/fitting 6 disconnected from the supply hose 20 which is attached to the toilet 8. For the invention, a typical supply line/hose 20 is initially separated from the wall fitting/connection/inlet 9 that can be mounted to a wall 4.

Figure 4B:
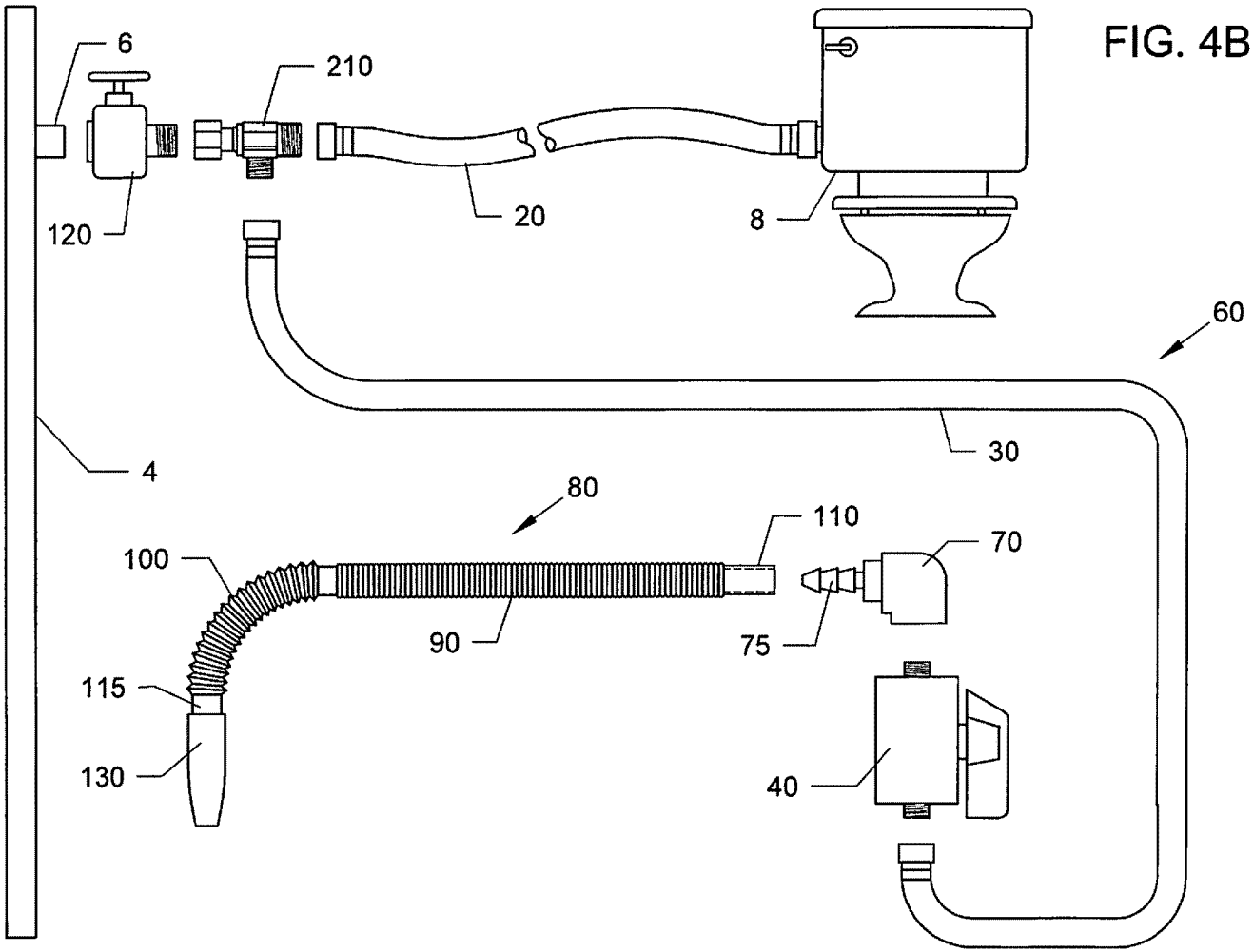
FIG. 4B is a modified view of FIG. 4A with another embodiment toilet wash system having a splitter positioned between the supply hose and the wall fitting, with an exploded view of wash system positioned for attachment.

FIG. 4B is a modified view of FIG. 4A with another embodiment system embodiment 60 having a splitter 210 positioned between the supply hose 20 and the wall fitting 9, with an exploded view of wash system 60 positioned for attachment. The wash system 60 can also include a supply line 30 that can run from the splitter 210 to a main single valve 40, which can be attached to a barb connector 70 which can attach to a tube type want 80 by fitting a tube inner end section 110 over barbs 75 as a compression fitting of the barb connector 70. The wand tube 80 can include a rigid section 90 with a flexible section 100 and outer end 115 that can have a compression fitting into a base of a soft cleaning tip 130. The soft cleaning tip 130 can made from silicone, and the like.

Figure 4C:
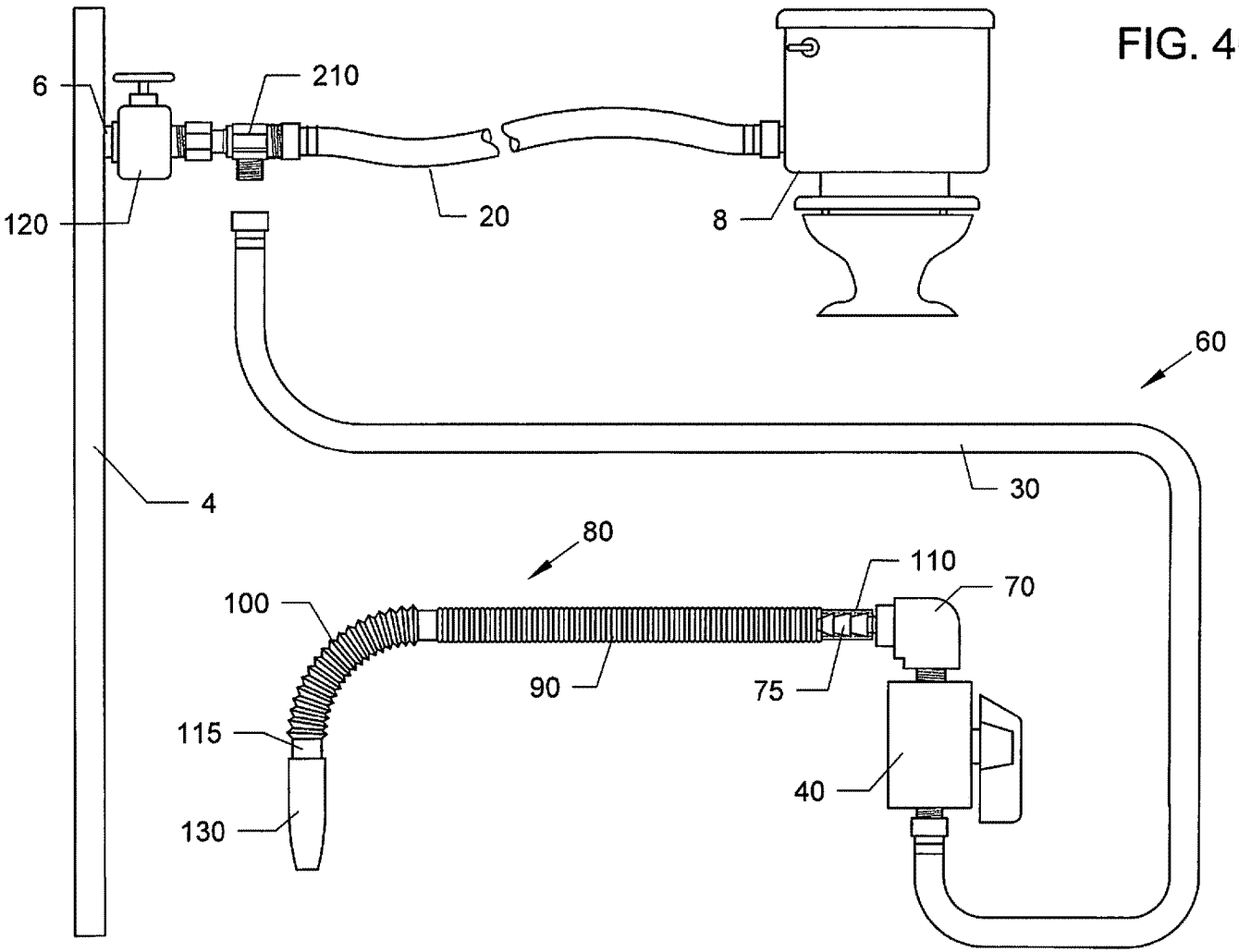
FIG. 4C is another view of FIG. 4B showing wash system assembled and ready for connection to the splitter which is now connected to wall fitting and the supply hose.

FIG. 4C is another view of FIG. 4B showing wash system 60 assembled and ready for connection to attach the supply line 30 to the splitter 210 which is now connected to wall fitting 6 and the toilet supply hose 20.

Figure 4D:
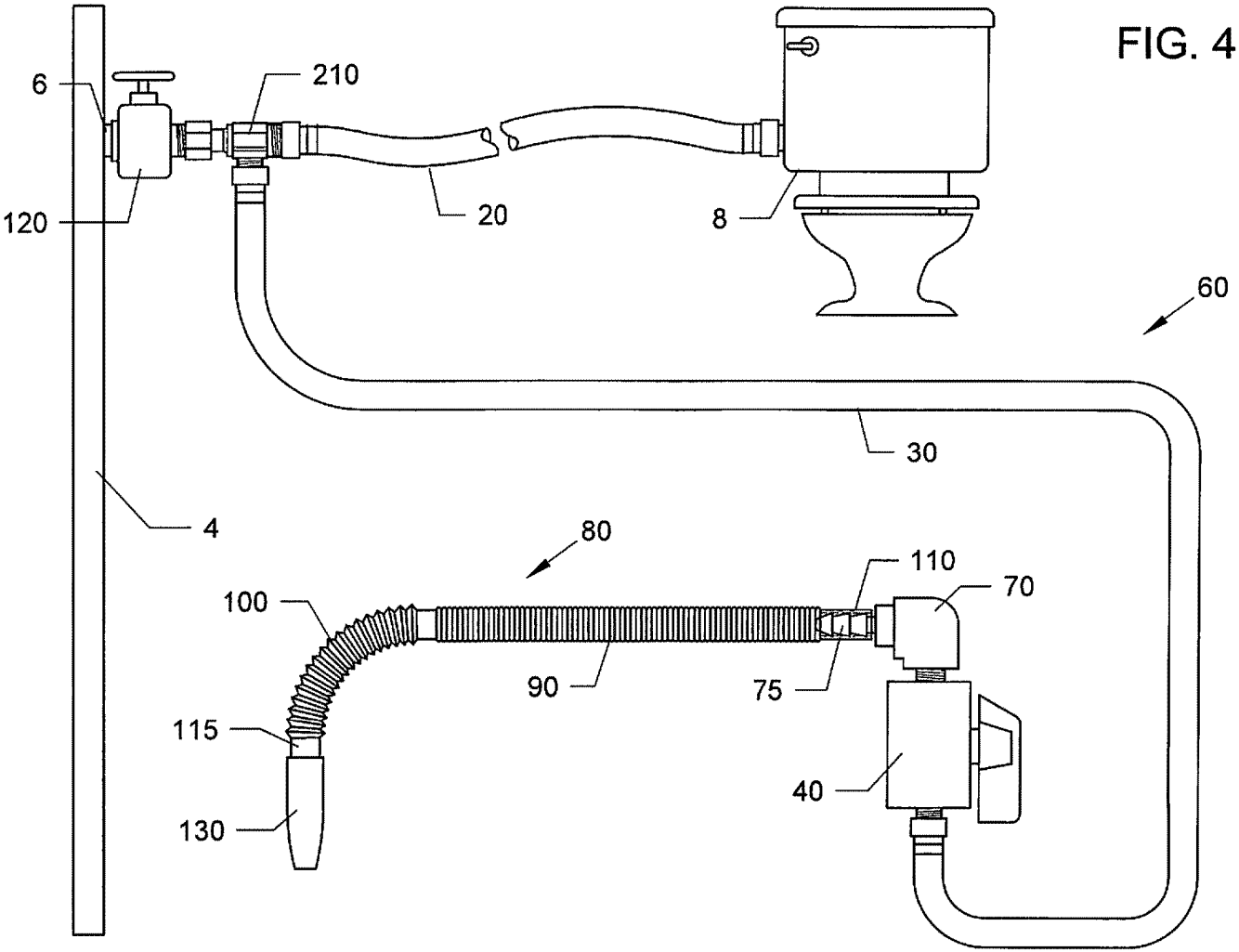
FIG. 4D is another view of FIG. 4C with the assembled wash system connected to the splitter which is connected to both the wall fitting and the supply hose.

FIG. 4D is another view of FIG. 4C with the assembled wash system 60 connected by the supply line 30 to the splitter 210 which is connected to both the wall fitting 6 and the toilet supply hose 20.

Figure 5C:
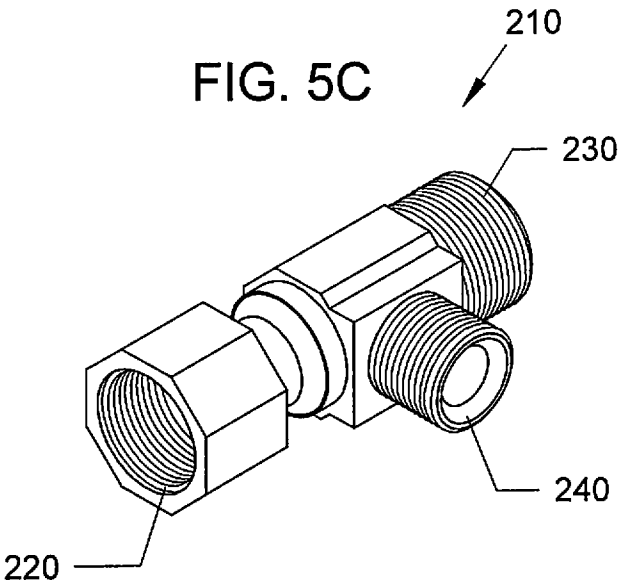
FIG. 5C is a perspective view of the splitter of FIGS. 5A-5B.
Figure 5A:
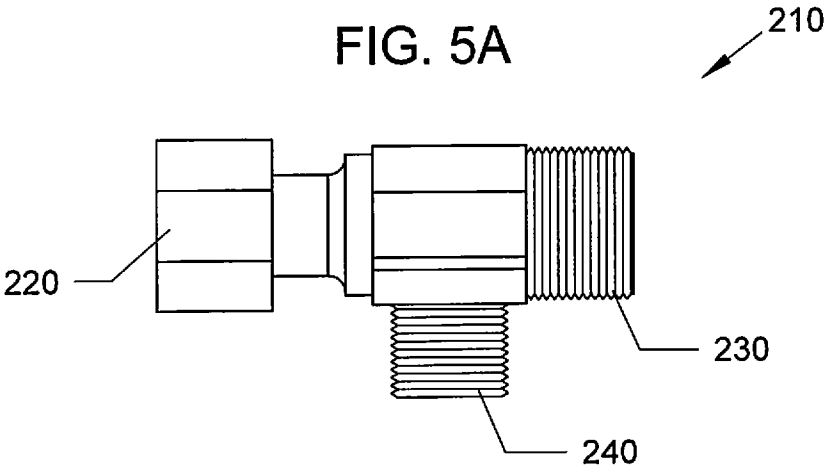
FIG. 5A is a top view of the splitter used in FIGS. 4B-4D.
Figure 5B:
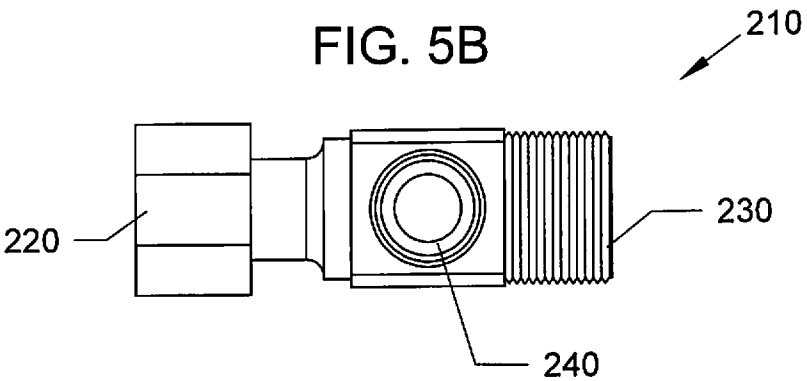
FIG. 5B is a front view of the splitter of FIG. 5A.

FIG. 5A is a top view of the splitter 210 used in FIGS. 4B-4D. FIG. 5B is a front view of the splitter 210 of FIG. 5A. FIG. 5C is a perspective view of the splitter 210 of FIGS. 5A-5B. The splitter 210 can have three ends that can include an approximately ⅜" female end, an approximately ⅜" male end and approximately ¼" male end.

Referring to FIGS. 4A-5C, the splitter 210 can include a splitter wall fitting connection 220 with internal threads (not shown) that can rotate about external threads on the wall fitting 6, and a splitter toilet connection 230 having external threads that can thread ably attach to internal threads of an outer end connector of the supply line/hose 20, and a side connection 240 having external threads that can thread ably attach to internal threads of a connector end of supply line 30.

Figure 6A:
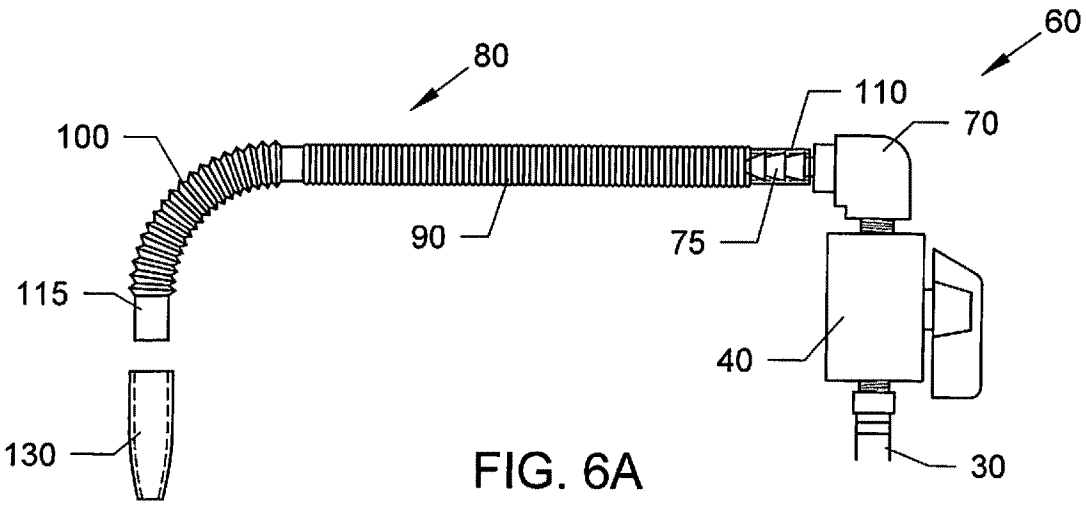
FIG. 6A is an exploded view of a removable soft tip separated from the disposable cleaning tube portion of the washing system.
Figure 6B:
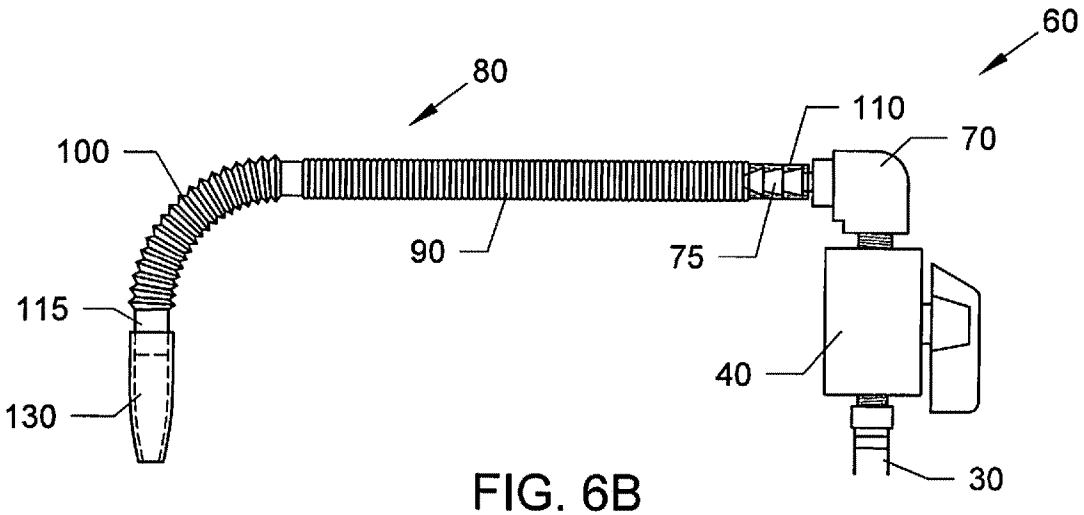
FIG. 6B is another view of FIG. 6A with the removable soft tip attached to the spray wand

FIG. 6A is an exploded view of a removable soft tip 130 separated from the cleaning tube portion 110 of the straw/wand 80 and wash system 60. FIG. 6B is another view of FIG. 6A with the removable soft tip 130 attached to the cleaning tube end 110 of the straw wand 80.

Figure 7A:
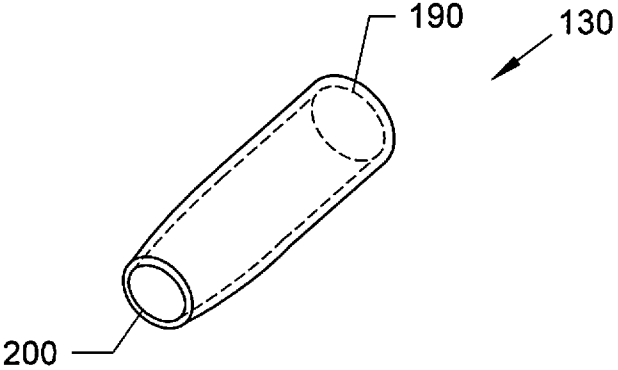
FIG. 7A is a perspective view of the soft tip of FIGS. 6A-6B.
Figure 7B:
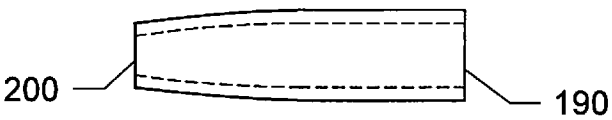
FIG. 7B is a side view of the soft tip of FIG. 7A.

FIG. 7A is a perspective view of the soft tip 130 of FIGS. 6A-6B. FIG. 7B is a side view of the soft tip 130 of FIG. 7A.

Referring to FIGS. 7A-7B, the removable soft tip 130 can include connection end 190 that can form a compression fitting with the outer end 110 of the straw wand 80, and a water outlet end 200 that can have a narrower diameter than the connection end 190.

Referring to FIGS. 4A-7B, the wash system 60 uses water pressure for spraying water at those areas in the anus region that needed to be clean.

Figure 8A:
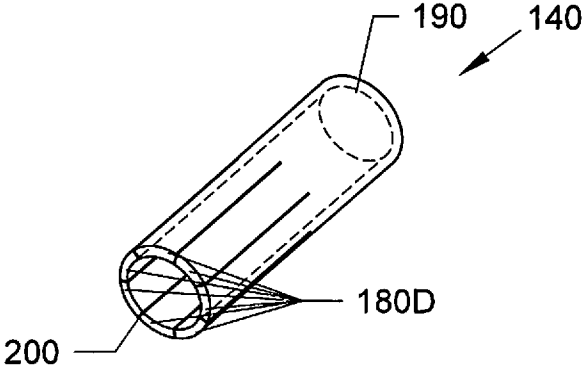
FIG. 8A is a perspective view of another removable soft tip with parallel slits forming a deep cleaning comb tip.
Figure 8B:
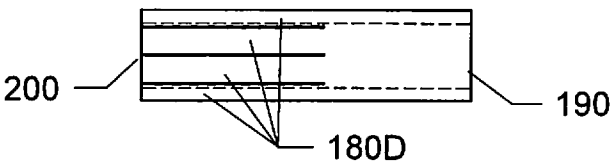
FIG. 8B is a side view of the deep comb tip of FIG. 8A.

FIG. 8A is a perspective view of another removable soft tip 140 with parallel slits 180D forming a deep cleaning comb tip. The parallel slits 180D that can have a length up to approximately a inch long, form comb type cleaning fingers. FIG. 8B is a side view of the deep comb tip of FIG. 8A.

Figure 9A:
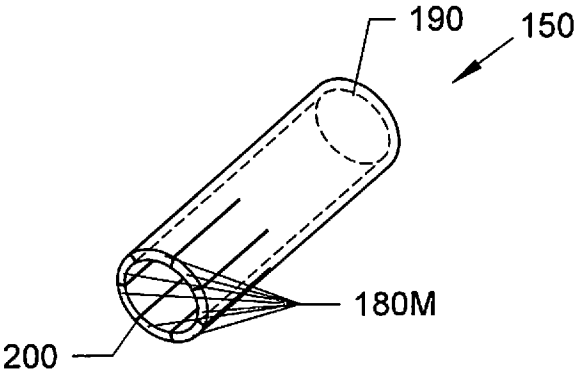
FIG. 9A is a perspective view of another removable soft tip with parallel slits forming a medium cleaning comb tip.
Figure 9B:
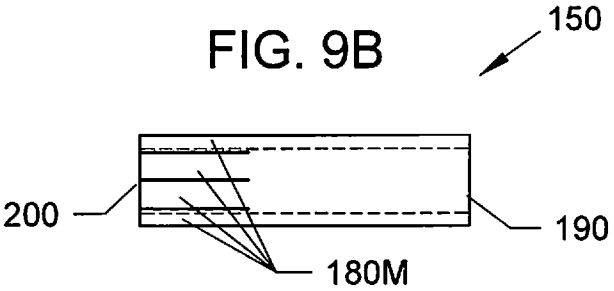
FIG. 9B is a side view of the medium comb tip of FIG. 9A.

FIG. 9A is a perspective view of another removable soft tip 150 with parallel slits 180M forming a medium cleaning comb tip. The parallel slits 180M that can have a length up to approximately a ⅜ inch long, form comb type cleaning fingers. FIG. 9B is a side view of the medium comb tip 150 of FIG. 9A.

Figure 10A:
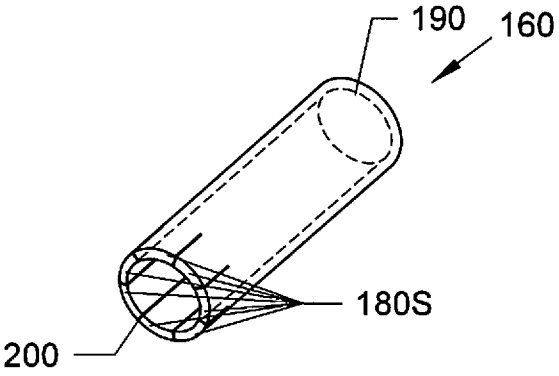
FIG. 10A is a perspective view of another removable soft tip with parallel slits forming a short cleaning comb tip.
Figure 10B:
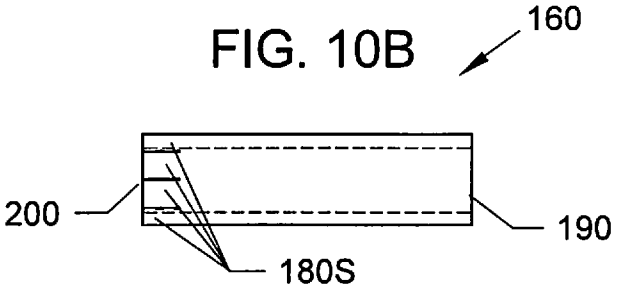
FIG. 10B is a side view of the soft comb tip of FIG. 10A.

FIG. 10A is a perspective view of another removable soft tip 160 with parallel slits 180S forming a short cleaning comb tip. The parallel slits 180S that can have a length up to approximately a ¼ inch long, form comb type cleaning fingers. FIG. 10B is a side view of the soft comb tip 160 of FIG. 10A.

Figure 11A:
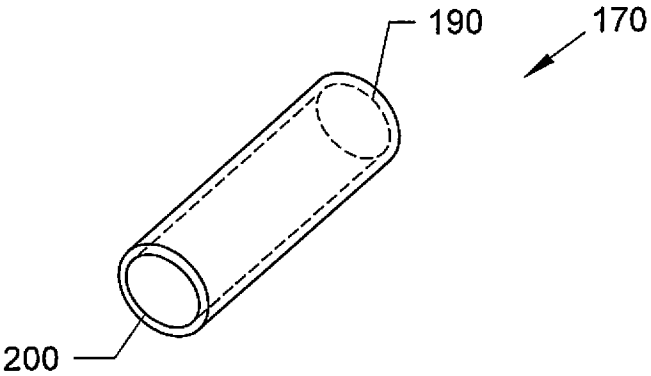
FIG. 11A is a perspective view of another removable soft tip with no comb slits.
Figure 11B:
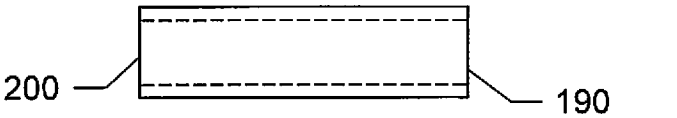
FIG. 11B is a side view of the no slit tip of FIG. 11A.

FIG. 11A is a perspective view of another removable soft tip 170 with no comb slits. FIG. 11B is a side view of the no slit tip 170 of FIG. 11A.

Referring to FIGS. 4A-11B, the wash system 60 can provide a new more effective cleaning device as a disposable rubby rinse head and add a new level of cleaning for stubborn waste that is hiding under the folds of skin, that spraying water cannot penetrate the waste that is under the folds of the skin. The disposable rubby rinse head attachment tips 130, 140, 150, 160 and 170 when used can lift the folds on the rear end of the user and wash out the waste that harbor the parasites and bacteria. And washing out the waste that other products cannot get to.

The disposable rubby rinse head attachment tips 130, 140, 150, 160 and 170 can be used with the wash system 60 to both brush and spray at the same time and can remove the most stubborn waste that support parasites that can cause irritation, sickness and death's in some cases. The private areas on the rear of the user can have numerous folds which makes it difficult to remove the waste that lies within these folds.

The novel toilet wash systems are intended to rid waste that diseases live in the private areas of the human body. The disposable rubby rinse head attachment tips 130, 140, 150, 160 and 170 include a variation of designs to better improve the cleaning efficiency of the private areas.

These different new parts to wands. Tips 140 FIGS. 8A-8B, 150 FIGS. 9A-9B and 160 FIGS. 10A-10B are three types of comb type brush attachments. Tip 130 FIGS. 7A-7B can form a jet stream, and tip 170 FIGS. 11A-11B is a smooth soft touch tip.

The novel tips 130, 140, 150, 160, 170 FIGS. 7A-11B can all be used to spray areas to clean with water and some of the tips 140, 150, 160 FIGS. 8A-10B can be used as brushes for lifting the folds under the skin to removing waste material that harbors parasites reducing the chances of these parasites from entering the urinary tract of females. These are the most difficult areas to rid stubborn waste material from on our body that infectious diseases growths on.

When using toilet paper products feces that get left behind can travel in females to vaginal opening and into the urethra, causing an infection. The novel tips 130, 140, 150, 160, 170 FIGS. 7A-11B can rid the bodies from waste that harbor infection as if it is in a Petri dish.

Referring to FIGS. 4B-4D, 6A and 6B, the bendable section 100 of the wand 80 can be positioned as a small or larger portion of the overall wand tube 80. The wand 80 is not permanently attached to the tips 130, 140, 150, 160, 170 FIGS. 7A-11B in a similar way that the handle of an electric toothbrush is detached from the bristles section so the bristles section can be cleaned.

The tips 130, 140, 150, 160, 170 FIGS. 7A-11B can be removed for cleaning, or to replace it with a new one by simply twisting it off, no tools are necessary. When removed it is recommended that an antibacterial liquid soap be used. There are different tips 130, 140, 150, 160, 170 FIGS. 7A-11B that slide over the smooth section of the end 110 of the wand 80 it uses suction to adhere.

The bendable section 100 of the wand 80 can be up to approximately 8½" inches long or up to approximately 80% of the wand 80, with an outside dimension of approximately 11/32" and an inside diameter of approximately 5/16" inch, it is distinguishable because its ridges that make it bendable so that difficult areas of the body can be reached.

The smooth unbendable sections 110, 115 FIGS. 4A-4D, 6A and 6B can be found at both ends of the tube and can be approximately 1" inch long with an outside dimension of approximately 11/32" and an inside diameter of approximately 5/16" inch. This smooth section 110 allows the wand 80 to slide over the hose barb 75. The other side end 115 of the wand 80 can be used for attaching the tips 130, 140, 150, 160, 170 FIGS. 7A-11B by sliding over the other smooth sections 190 of the tips 130, 140, 150, 160, 170 FIGS. 7A-11B. The tips 130, 140, 150, 160, 170 can be approximately 2" long with outside dimensions of approximately 29/64" inch and the inside dimensions of approximately 21/64" inch.

As previously described, the comb type brushes 140-160 in FIGS. 8A-10B can have three different lengths. The shortest brush length on the comb brush 160 can have fingers/slits 180S FIGS. 10A-10B that can be approximately ¼ inch long. The medium size 180M on the comb brush 150 can be approximately ⅜ inch long and the longest length 180D of the comb brush 150 FIGS. 9A-9B can have fingers/slits of approximately ½" inch long. The jet stream tip 130 FIGS. 7A-7B can use a softer and gentler rubber while spraying and rubbing to remove stubborn waste material. The smooth touch tip 170 FIGS. 11A-11B can have a cylinder shape, of silicone rubber that would provide for both spraying and a gently rubbing action when being used.

The term "approximately" can be +/−10% of the amount referenced. Additionally, preferred amounts and ranges can include the amounts and ranges referenced without the prefix of being approximately.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A toilet wash system, comprising:

a splitter having an inlet for being attached to a toilet shut off valve, and having a first outlet and a second outlet;

a first supply line attached to the first outlet of the splitter and an opposite end for being attached to a water inlet port of a toilet;

a second supply line attached to the second outlet of the splitter and an outlet end;

a single valve with an inlet port attached to the outlet end of the second supply line, and an opposite end;

an elongated cleaning tube having an inlet end attached to the opposite end of the single valve, and an outlet end, wherein the outlet end of the cleaning tube is used to flush waste away; and a disposable removable tip for being attached to the outlet end of the cleaning tube, the removable tip includes an external end having longitudinal parallel slits that form fingers for use a cleaning brush.

2. The toilet wash system of claim 1, wherein the disposable removable tip includes:

a generally uniform cylindrical shape formed from a pliable soft material.

3. The toilet wash system of claim 1, wherein the removable tip includes:

a base opening that has a larger diameter than an outer narrower diameter tip end, wherein the narrower diameter tip end forms a smaller diameter tip for penetrating smaller areas for cleaning.

4. The toilet wash system of claim 1, wherein the slits have a length of approximately ¼ inch long for use as fingers as a cleaning brush.

5. The toilet wash system of claim 1, wherein the slits have a length of approximately ⅜ inch long for use as fingers as a cleaning brush.

6. The toilet wash system of claim 1, wherein the slits have a length of approximately ½ inch long for use as fingers as a cleaning brush.

7. The toilet wash system of claim 1, wherein the disposable elongated cleaning tube includes:

a disposable paper straw.

8. The toilet wash system of claim 1, wherein the elongated cleaning tube includes:

a plastic straw.

9. The toilet wash system of claim 1, wherein the disposable elongated cleaning tube includes:

a disposable silicone tube.

10. The toilet wash system of claim 1, wherein the elongated cleaning tube includes:

a flexible bendable tube.

11. The toilet wash system of claim 10, wherein the flexible bendable tube is between approximately 20 degrees and approximately 90 degrees.

12. The toilet wash system of claim 11, wherein the flexible bendable tube is approximately 90 degrees.

13. The toilet wash system of claim 1, further comprising:

a barb connector having one end attached to the single valve and an opposite end having a plurality of barbs that are press fit into the inlet end of the disposable tube.

14. The toilet wash system of claim 13, wherein the disposable tube includes a paper tube having an inlet end that fits over the hose barb.

15. The toilet wash system of claim 1, wherein the disposable elongated cleaning tube includes:

a package of a plurality of identical elongated cleaning tubes.

16. A toilet wash system, comprising:

a splitter having an inlet for being attached to a toilet shut off valve, and having a first outlet and a second outlet;

a first supply line attached to the first outlet of the splitter and an opposite end for being attached to a water inlet port of a toilet;

a second supply line attached to the second outlet of the splitter and an outlet end;

a single valve with an inlet port attached to the outlet end of the second supply line, and an opposite end;

an elongated cleaning tube having an inlet end attached to the opposite end of the single valve, and an outlet end, wherein the outlet end of the cleaning tube is used to flush waste away, wherein the elongated cleaning tube includes:

a plurality of parallel rings between the inlet end and the outlet end of the tube, the plurality of parallel rings allowing the outlet end of the tube to be selectively bent from a straight position to an approximately 90 degree bend.

* * * * *